US012442213B2

(12) United States Patent
He et al.

(10) Patent No.: US 12,442,213 B2
(45) Date of Patent: Oct. 14, 2025

(54) MULTIFUNCTIONAL UMBRELLA TENT

(71) Applicant: ZHEJIANG YOUYI FEINUO UMBRELLA CO., LTD., Shaoxing (CN)

(72) Inventors: Jinfei He, Shaoxing (CN); Jianshu Xu, Shaoxing (CN); Chenghua Wang, Shaoxing (CN); Yumin Liu, Shaoxing (CN); Qiuliang Ren, Shaoxing (CN)

(73) Assignee: ZHEJIANG YOUYI FEINUO UMBRELLA CO., LTD., Shaoxing (CN)

( * ) Notice: Subject to any disclaimer, the term of this patent is extended or adjusted under 35 U.S.C. 154(b) by 267 days.

(21) Appl. No.: 18/378,632

(22) Filed: Oct. 10, 2023

(65) Prior Publication Data

US 2024/0035300 A1 Feb. 1, 2024

(51) Int. Cl.

| | |
|---|---|
| ***E04H 15/28*** | (2006.01) |
| ***A45B 23/00*** | (2006.01) |
| ***A45B 25/02*** | (2006.01) |
| ***A45B 25/08*** | (2006.01) |
| ***A45B 25/10*** | (2006.01) |

(52) U.S. Cl.

CPC ..... *E04H 15/28* (2013.01); *A45B 23/00* (2013.01); *A45B 25/02* (2013.01); *A45B 25/08* (2013.01); *A45B 25/10* (2013.01); *A45B 2200/1072* (2013.01)

(58) Field of Classification Search

CPC ..... E04H 15/28; A45B 25/06; A45B 25/08

See application file for complete search history.

(56) References Cited

U.S. PATENT DOCUMENTS

| | | | | |
|---|---|---|---|---|
| 501,089 | A * | 7/1893 | Lichtenstein | A45B 25/06 135/33.4 |
| 847,805 | A * | 3/1907 | McAvoy | A45B 25/06 135/30 |
| 7,793,674 | B2 * | 9/2010 | Elder | E04H 15/28 135/33.7 |
| 9,629,428 | B1 * | 4/2017 | Nei | A45B 25/18 |
| 10,182,627 | B2 * | 1/2019 | Nei | A45B 25/02 |
| 11,421,440 | B2 * | 8/2022 | Bird | E04H 15/001 |
| 11,998,092 | B2 * | 6/2024 | Luo | A45B 25/06 |
| 2003/0015231 | A1 * | 1/2003 | Ma | A45B 25/10 135/33.6 |
| 2005/0011134 | A1 * | 1/2005 | Boltan | E04H 15/003 52/3 |

(Continued)

*Primary Examiner* — Noah Chandler Hawk

(74) *Attorney, Agent, or Firm* — Shen Huang

(57) ABSTRACT

The present invention relates to the technical field of sun-shading articles, and particularly discloses a multifunctional umbrella tent, including an umbrella surface, umbrella ribs, an umbrella disc assembly, an umbrella rod and ear pieces. The umbrella ribs support the umbrella surface, the umbrella disc assembly is hinged in the middle of the umbrella ribs, and the umbrella rod is connected to the lower end of the umbrella disc assembly; the ear pieces are triangular and detachably connected to both sides of the umbrella surface in an expanded state; the umbrella ribs are evenly arranged on the lower end of the umbrella surface peripherally, and include a plurality of long ribs and a plurality of short ribs; and the umbrella disc assembly includes an umbrella cap, an upper disc, a lower disc and an outer lock of the lower disc.

10 Claims, 22 Drawing Sheets

(56) References Cited

U.S. PATENT DOCUMENTS

| | | | |
|---|---|---|---|
| 2014/0261597 | A1 | 9/2014 | Lin |
| 2020/0123802 | A1 | 4/2020 | Lafoux et al. |
| 2021/0238880 | A1 | 8/2021 | Qiu et al. |

* cited by examiner

MULTIFUNCTIONAL UMBRELLA TENT

TECHNICAL FIELD

The present invention relates to the technical field of sunshading articles, and particularly relates to a multifunctional umbrella tent.

BACKGROUND

The function of a sunshade is to block the harmful ultraviolet rays released by the sunlight from irradiating on the body. The sunshade forms a shadow through the cloth with a reflective effect to block a light source from directly irradiating on the skin, so as to reduce the penetration of the ultraviolet rays.

The existing sunshade or awning has single function. When users sometimes want to use both a beach umbrella and a tent outdoors, ordinary products cannot satisfy the needs of customers at the same time. Therefore, it is necessary to design a product which can be arbitrarily converted between the beach umbrella and the tent to overcome the limitation of single sunshading function of the existing sunshade.

SUMMARY

In view of this, the present invention proposes a multifunctional umbrella tent, which has the following specific technical solution:

A multifunctional umbrella tent comprises an umbrella surface, umbrella ribs, an umbrella disc assembly, an umbrella rod and ear pieces; the umbrella ribs support the umbrella surface, the umbrella disc assembly is hinged in the middle of the umbrella ribs, and the umbrella rod is connected to the lower end of the umbrella disc assembly; the ear pieces are triangular and detachably connected to both sides of the umbrella surface in an expanded state; and when the multifunctional umbrella tent is expanded into a tent state, the bottom edges of the ear pieces are in direct contact with the ground.

The umbrella ribs are evenly arranged on the lower end of the umbrella surface peripherally, and comprise a plurality of long ribs and a plurality of short ribs; the long ribs and the short ribs have the same quantity and are located in the same vertical plane; the long ribs are fixedly connected with the umbrella surface, and the short ribs are located at the lower ends of the long ribs; and one end of the short ribs away from the umbrella disc assembly are hinged with the corresponding long ribs.

The umbrella disc assembly comprises an umbrella cap, an upper disc, a lower disc and an outer lock of the lower disc. an upper part of the upper disc is an upper hollow pipe with external threads, a middle part is an upper disc seat extending outward, and a lower part is a first lower hollow pipe; an upper part of the lower disc is a conical hollow lug boss having a limiting notch on the outer side, a middle part is a lower disc seat extending outward, and a lower part is a second lower hollow pipe; the upper hollow pipe is in threaded connection with the umbrella cap located above the umbrella surface; the upper part of the inner pipe wall of the first lower hollow pipe is provided with an umbrella rod internal thread; an inner hole at the lower part of the umbrella rod internal thread is a conical hole of the upper disc; the inner side wall of the conical hole of the upper disc is provided with a limiting bump; the conical hollow lug boss is matched and extended into the conical hole of the upper disc; the outer wall of the limiting notch is matched and fitted with the inner wall of the limiting bump; a first annular groove is arranged at the periphery of the upper disc seat; the near ends of the long ribs are fixed on an iron wire wrapped in the first annular groove; a second annular groove is arranged at the periphery of the lower disc seat; the near ends of the short ribs are fixed on an iron wire wrapped in the second annular groove; the peripheral upper part of the second lower hollow pipe is provided with a locking external thread; a plurality of strip-shaped grooves are arranged at the circumferential direction of the lower part of the second lower hollow pipe; the outer lock of the lower disc is a hollow pipe body, and the upper part of an inner hole wall is provided with a locking internal thread matched with the locking external thread; a lower inner hole of the locking internal thread is a conical hole of the outer lock of the lower disc; the lower end of the conical hole of the outer lock of the lower disc is a small opening end; the diameter of the small opening end is less than the outer diameter of the lower part of the second lower hollow pipe, and is slightly greater than the rod diameter of the umbrella rod; and the upper end of the umbrella rod is connected with a thread plug matched with the umbrella rod internal thread.

Preferably, the ear pieces are composed of two hinged supporting rods and a triangular cloth surface connected between the two supporting rods; the free ends of the supporting rods are provided with connecting pieces I; both ends of the connecting sides of the ear pieces on the umbrella surface are provided with connecting pieces II matched with the connecting pieces I; each connecting piece I is composed of a supporting rod inserting pipe and a sphere connecting seat fixedly connected with the supporting rod inserting pipe; the sphere connecting seat is provided with a sphere channel and a sphere rotating groove which is located at the inner side of the sphere channel and communicated with the sphere channel; each connecting piece II is composed of an umbrella surface connecting seat and a sphere connecting piece fixedly connected with the umbrella surface connecting seat; the umbrella surface connecting seat is correspondingly inserted into the outer end of the umbrella rib on the umbrella surface and is fixedly spliced with the umbrella surface; the connecting rod on the sphere connecting piece is matched through the sphere channel, and a sphere located at the top end of the connecting rod is matched into the sphere rotating groove.

Preferably, the hinged end of one of the supporting rods is connected with a hinging piece I, and the hinged end of the other supporting rod is connected with a hinging piece II; the hinging piece I is a linear hinging piece; one end of the hinging piece I is a supporting rod inserting head I, and the other end is a hinging head I; the hinging piece II is a curved hinging piece; one end of the hinging piece II is a supporting rod inserting head II, and the other end is a hinging head II; and the hinging head I and the hinging head II are jointly connected by a pivoting rod.

Preferably, ground nail fixing straps I are installed on the bottom edges of the ear pieces and on the edge of the umbrella surface between the two ear pieces.

Preferably, the multifunctional umbrella tent further comprises a ground mat matched with the multifunctional umbrella tent; the ground mat is located below the umbrella surface and the ear pieces; and when the multifunctional umbrella tent is expanded into a tent state, the edge of the ground mat is fitted and aligned with the bottom edges of the two ear pieces and the edge of the umbrella surface located between the two ear pieces.

Preferably, the edge of the ground mat is provided with ground nail fixing straps II, and the ground nail fixing straps II at the corresponding positions on the ground mat correspond up and down to the ground nail fixing straps I on the upper ear pieces and the edge of the umbrella surface.

Preferably, long rib installing grooves having the same number as the long ribs are arranged at the outer circumference of the upper disc seat; the near ends of the long ribs extend into the long rib installing grooves; short rib installing grooves having the same number as the short ribs are arranged at the outer circumference of the lower disc seat; and the near ends of the short ribs extend into the short rib installing grooves.

Preferably, the upper disc seat is provided with an upper disc seat notch; the lower disc seat is provided with a lower disc seat notch; the upper disc seat notch and the lower disc seat notch are both splayed and a groove is formed in the middle; and the ends of the upper disc seat notch and the lower disc seat notch are inserted into the groove after bound with the iron wires.

Preferably, the lower end of the umbrella rod is a tip.

Preferably, the umbrella rod comprises an upper umbrella rod and a lower umbrella rod, the upper end of the upper umbrella rod is connected with the thread plug, and the lower end of the lower umbrella rod is the tip; the lower end of the upper umbrella rod is inserted into an upper opening of the lower umbrella rod, and the connection between the upper umbrella rod and the lower umbrella rod is provided with a lever locking piece; when the lever locking piece is in an open state, the upper umbrella rod can slide freely relative to the lower umbrella rod; and when the lever locking piece is in a locking state, the upper umbrella rod and the lower umbrella rod are fixedly connected.

Compared with the prior art, the multifunctional umbrella tent of the present invention can be arbitrarily converted between a beach umbrella and a tent, the ear pieces and the umbrella rod can also be disassembled and used, and the umbrella rod is locked by the outer lock of the lower disc in design, so that the umbrella rod cannot rotate without external force, thereby preventing the umbrella rod from being loosened and achieving strong practicability.

When the present invention is used as a tent, the present invention can be used with the ground mat; at the same time, the barrier in the middle of the umbrella rod can be removed, and the user can feel the increase of the using space. The ground mat, the umbrella surface and the ear pieces are fixed by the ground nails at the same time to ensure the use stability of the tent.

When the present invention is used as a beach umbrella, the present invention is an ordinary beach umbrella which has two purposes. At the same time, the lower end of the umbrella rod is a tip, which is convenient for inserting into the ground. The umbrella rod is composed of the upper umbrella rod and the lower umbrella rod which are slidably connected, so as to realize the length adjustment of the umbrella rod.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

In the figures: 1—umbrella surface, 2—umbrella rib, 3—umbrella disc assembly, 4—umbrella rod, 5—ear piece, 6—long rib, 7—short rib, 8—umbrella cap, 9—upper disc, 10—lower disc, 11—outer lock of lower disc, 12—upper hollow pipe, 13—upper disc seat, 14—first lower hollow pipe, 15—conical hollow lug boss, 16—lower disc seat, 17—second lower hollow pipe, 18—umbrella rod internal thread, 19—conical hole of upper disc, 20—limiting bump, 21—limiting notch, 22—first annular groove, 23—second annular groove, 24—locking external thread, groove, 26—locking internal thread, 27—conical hole of outer lock of lower disc, 28—threaded plug, 29—supporting rod, 30—connecting piece I, 31—connecting piece II, 32—supporting rod inserting pipe, 33—sphere connecting seat, 34—sphere channel, 35—sphere rotating groove, 36—umbrella surface connecting seat, 37—sphere connecting piece, 38—hinging piece I, 39—hinging piece II, 40—supporting rod inserting head I, 41—hinging head I, 42—supporting rod inserting head II, 43—hinging head II, 44—ground mat, 45—long rib installing groove, 46—short rib installing groove, 47—upper disc seat notch, 48—lower disc seat notch, 49—upper umbrella rod, 50—lower umbrella rod, and 51—lever locking piece.

DETAILED DESCRIPTION

Embodiments of the present invention will be described below in detail. Examples of the embodiments are shown in drawings, wherein same or similar reference signs refer to same or similar elements or elements having same or similar functions from beginning to end. Embodiments described below by reference to the drawings are exemplary embodiments, and are used for explaining the present invention, and shall not be understood as a limitation to the present invention.

It should be understood in the description of the present invention that terms such as "upper", "lower", "front", "rear", "left", "right", "vertical", "horizontal", "top", "bottom", "inner", "outer", etc. indicate direction or position relationships shown based on the drawings, and are only intended to facilitate the description of the present invention and the simplification of the description rather than to indicate or imply that the indicated device or element must have a specific direction or constructed and operated in a specific direction, and therefore, shall not be understood as a limitation to the present invention.

In addition, the terms such as "first" and "second" are only used for the purpose of description, rather than being understood to indicate or imply relative importance or hint the number of indicated technical features. Thus, the features limited by "first" and "second" can explicitly or impliedly comprise one or more features. In the description of the present invention, the meaning of "a plurality of" is two or more unless otherwise clearly specified.

EMBODIMENTS

Figure 1:
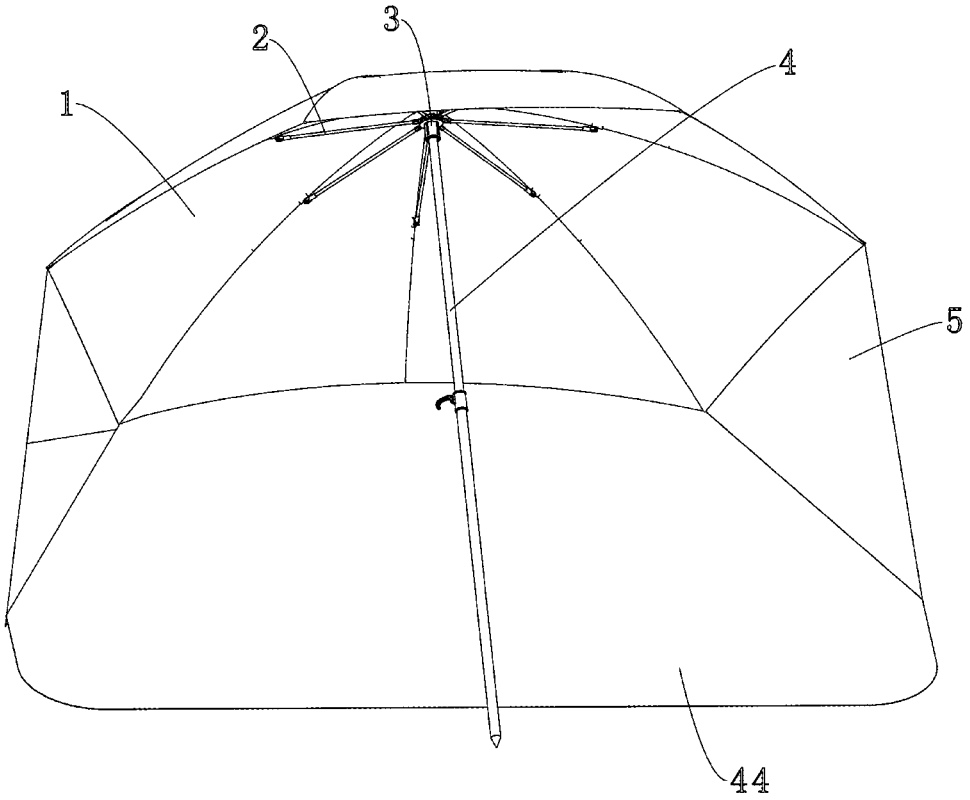
FIG. 1 is a schematic diagram of a first use state of the present invention.
Figure 2:
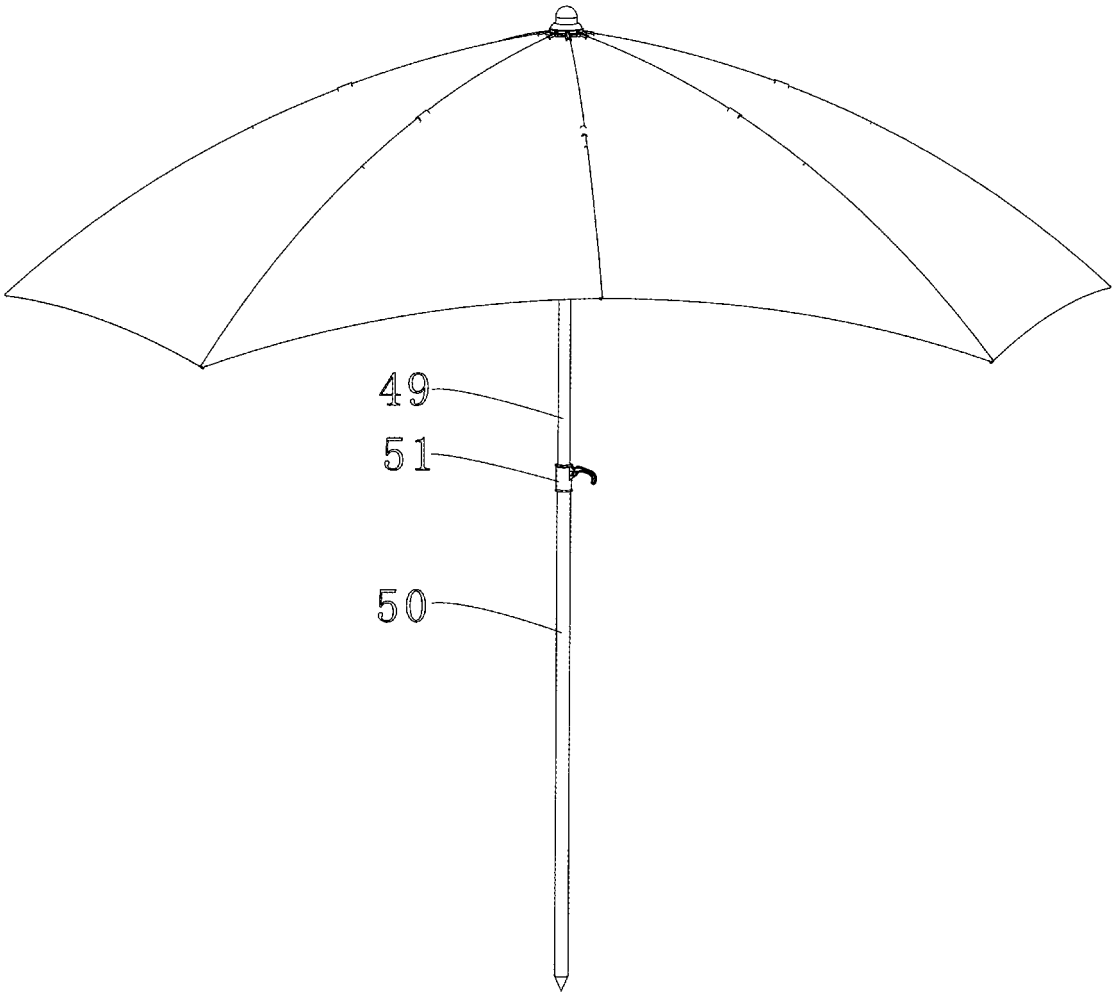
FIG. 2 is a schematic diagram of a second use state of the present invention.
Figure 3:
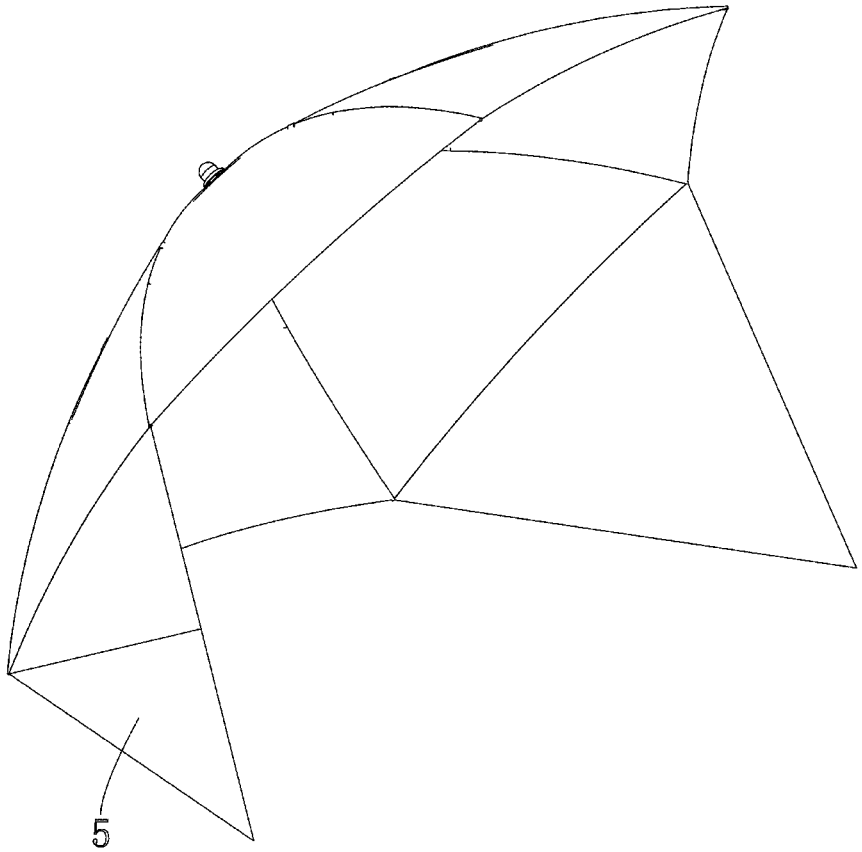
FIG. 3 is a schematic diagram of a third use state of the present invention.

As shown in FIG. 1 and FIG. 2, the present invention provides a multifunctional umbrella tent, mainly comprising an umbrella surface 1, umbrella ribs 2, an umbrella disc assembly 3, an umbrella rod 4 and ear pieces 5.

Wherein the umbrella ribs 2 support the umbrella surface 1, the umbrella disc assembly 3 is hinged in the middle of the umbrella ribs 2, and the umbrella rod 4 is connected to the lower end of the umbrella disc assembly 3; and the ear pieces 5 are triangular and detachably connected to both sides of the umbrella surface 1 in an expanded state. As shown in FIG. 3, when the multifunctional umbrella tent is expanded into a tent state, the bottom edges of the ear pieces 5 are in direct contact with the ground.

Figure 22:
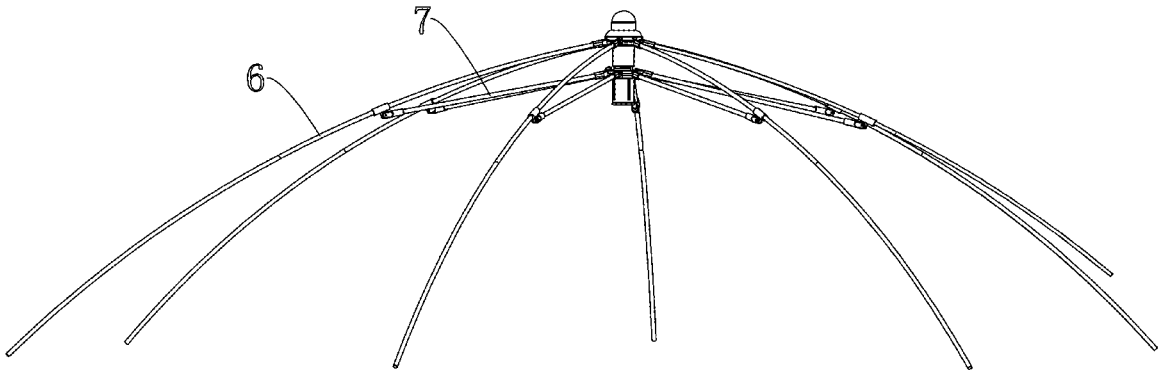
FIG. 22 is a schematic diagram of connection between umbrella ribs and the umbrella disc assembly.

The umbrella ribs 2 are evenly arranged on the lower end of the umbrella surface 1 peripherally. As shown in FIG. 22, the umbrella ribs 2 comprise a plurality of long ribs 6 and a plurality of short ribs 7; and long ribs 6 and the short ribs 7 have the same quantity and are located in the same vertical plane (a 7-rib umbrella tent is shown in the present embodiment, so the quantity of the long ribs 6 and the quantity of the short ribs 7 are both 7). The long ribs 6 are fixedly connected with the umbrella surface 1 and the short ribs 7 are located at the lower ends of the long ribs 6; and one end of the short ribs away from the umbrella disc assembly 3 are hinged with the corresponding long ribs 6.

Figure 4:
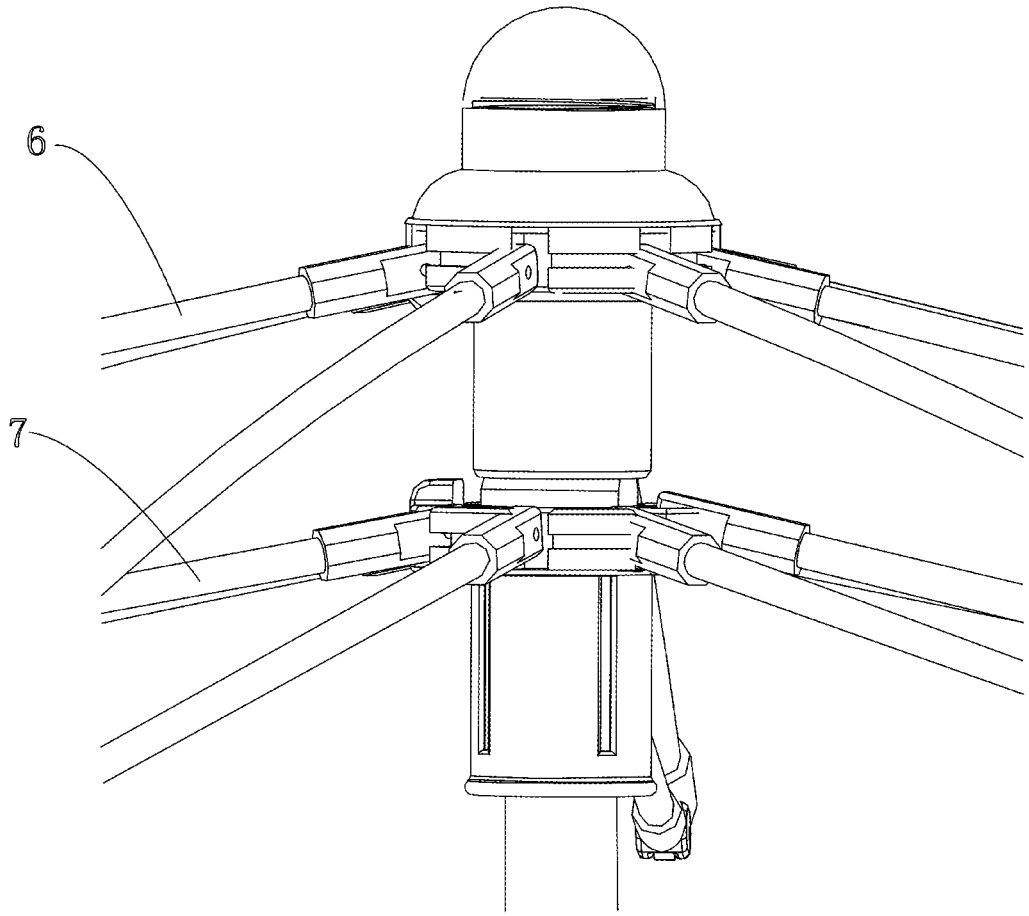
FIG. 4 is a schematic diagram of connection of an umbrella disc assembly.
Figure 5:
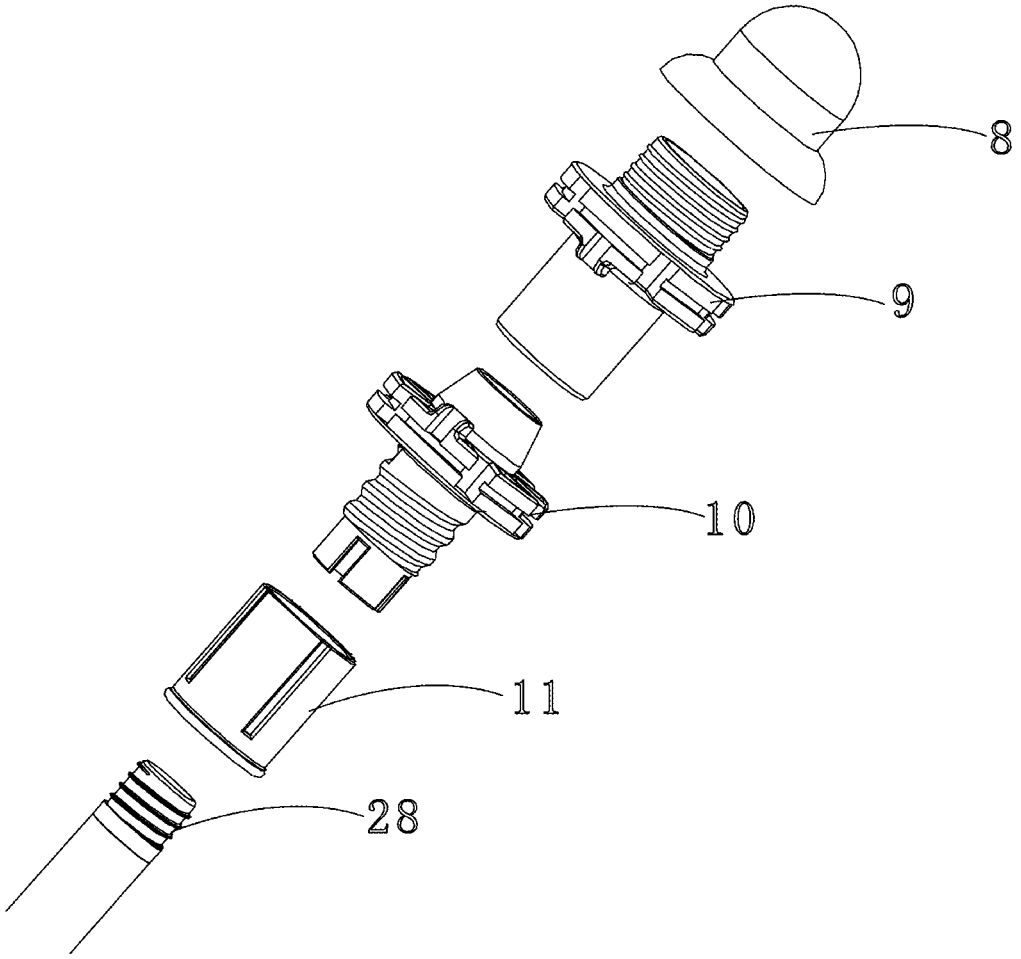
FIG. 5 is an exploded view of the umbrella disc assembly of FIG. 4.
Figure 6:
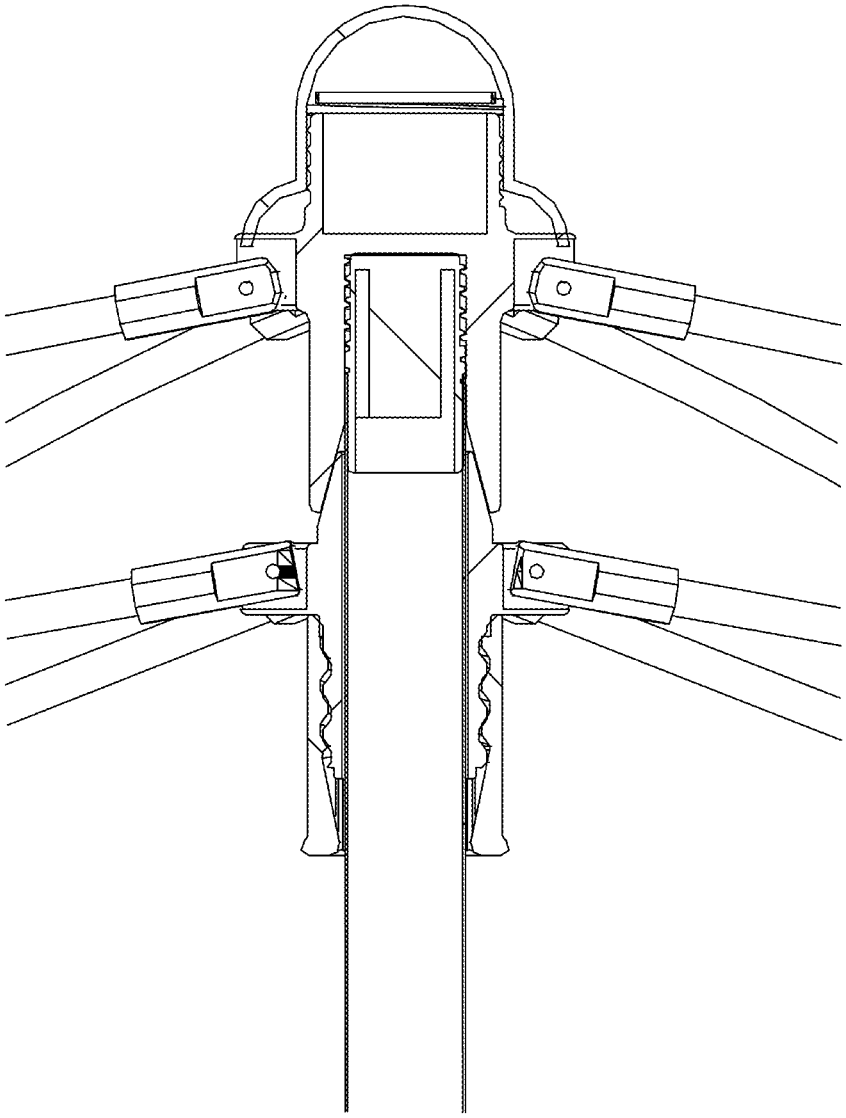
FIG. 6 is a sectional view of the umbrella disc assembly of FIG. 4.

As shown in FIG. 4-FIG. 6, the umbrella disc assembly 3 comprises an umbrella cap 8, an upper disc 9, a lower disc 10 and an outer lock 11 of the lower disc.

Figure 7:
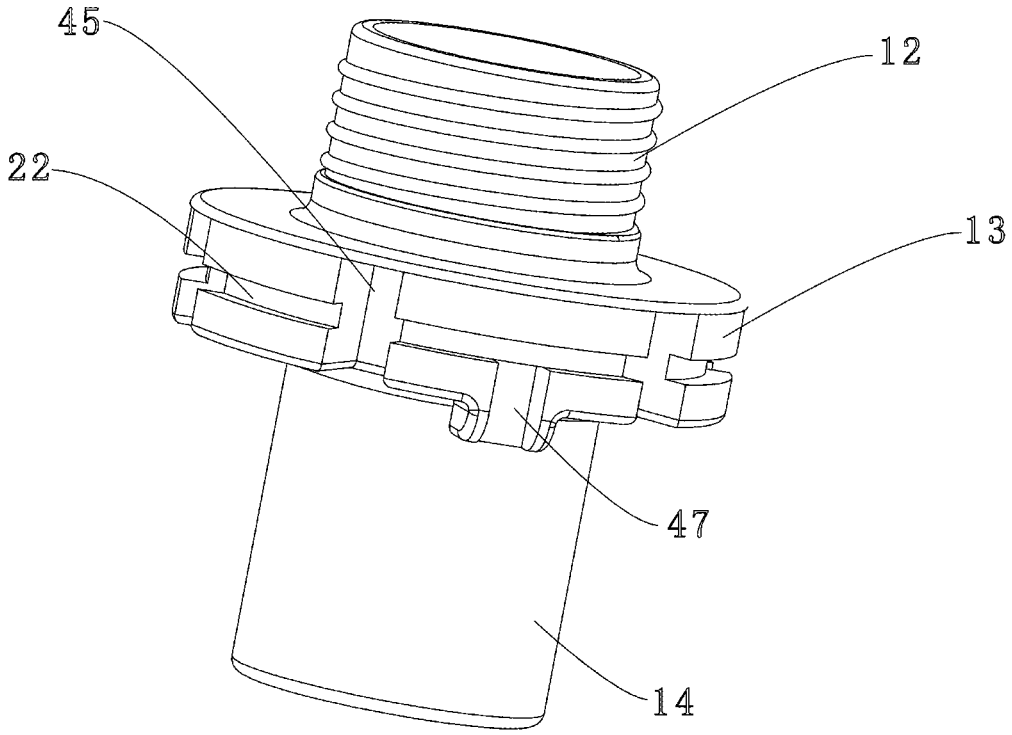
FIG. 7 is a three-dimensional diagram of an upper disc.
Figure 8:
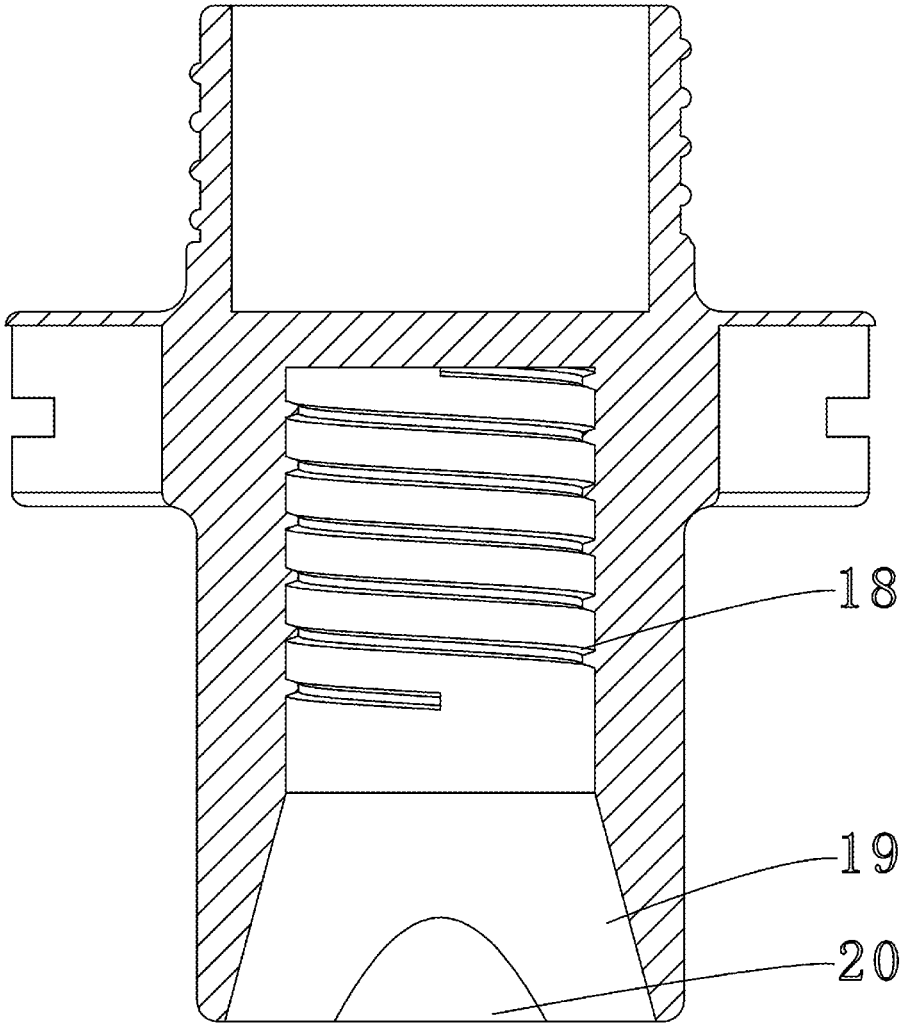
FIG. 8 is a sectional view of the upper disc.
Figure 9:
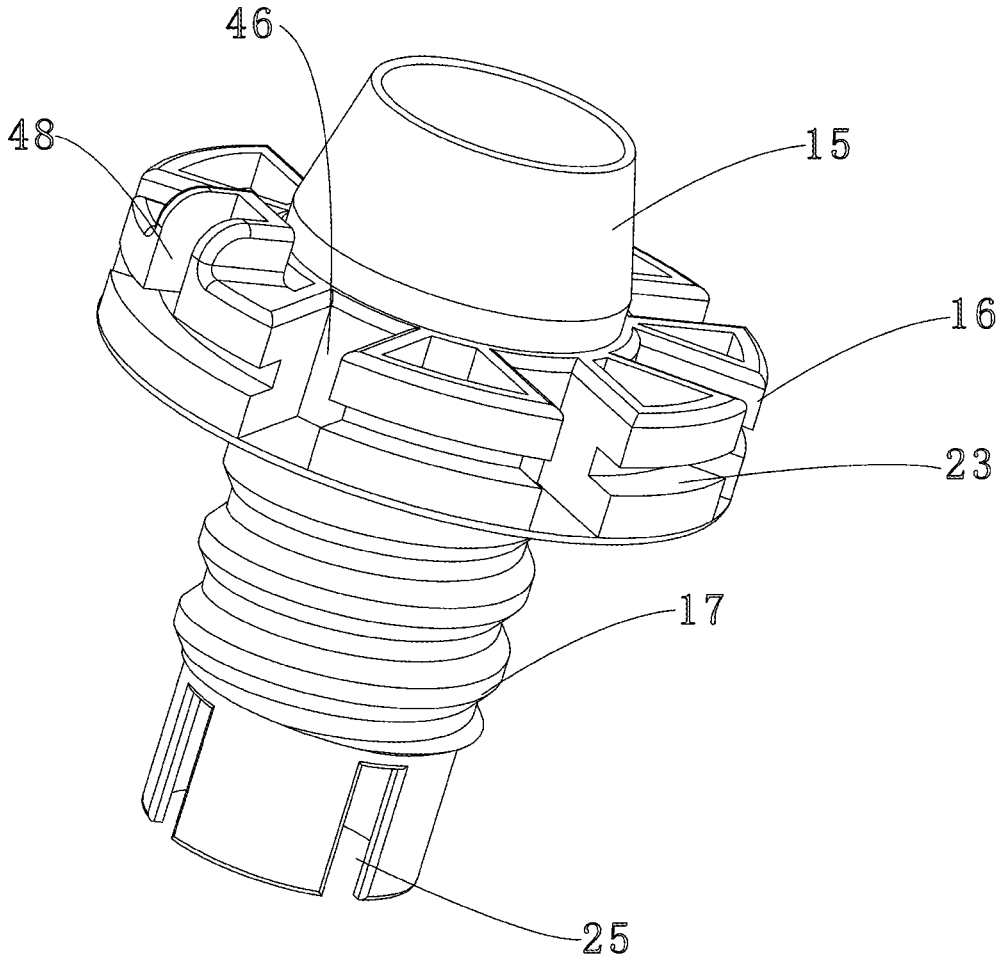
FIG. 9 is a three-dimensional diagram 1 of a lower disc.
Figure 10:
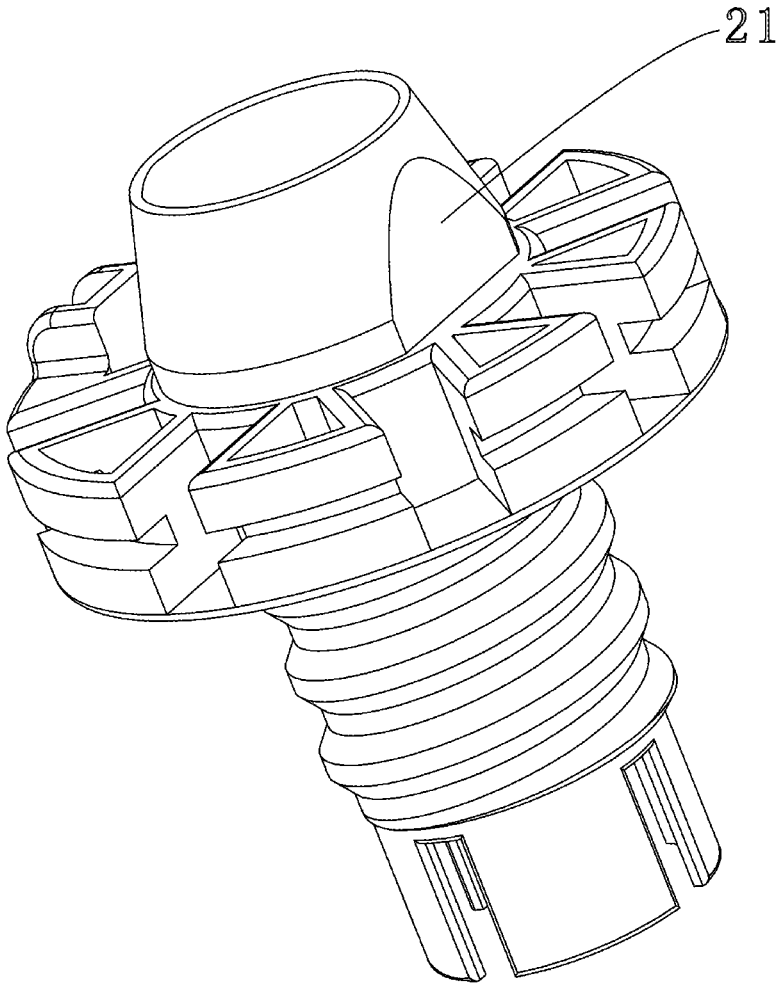
FIG. 10 is a three-dimensional diagram 2 of the lower disc.
Figure 11:
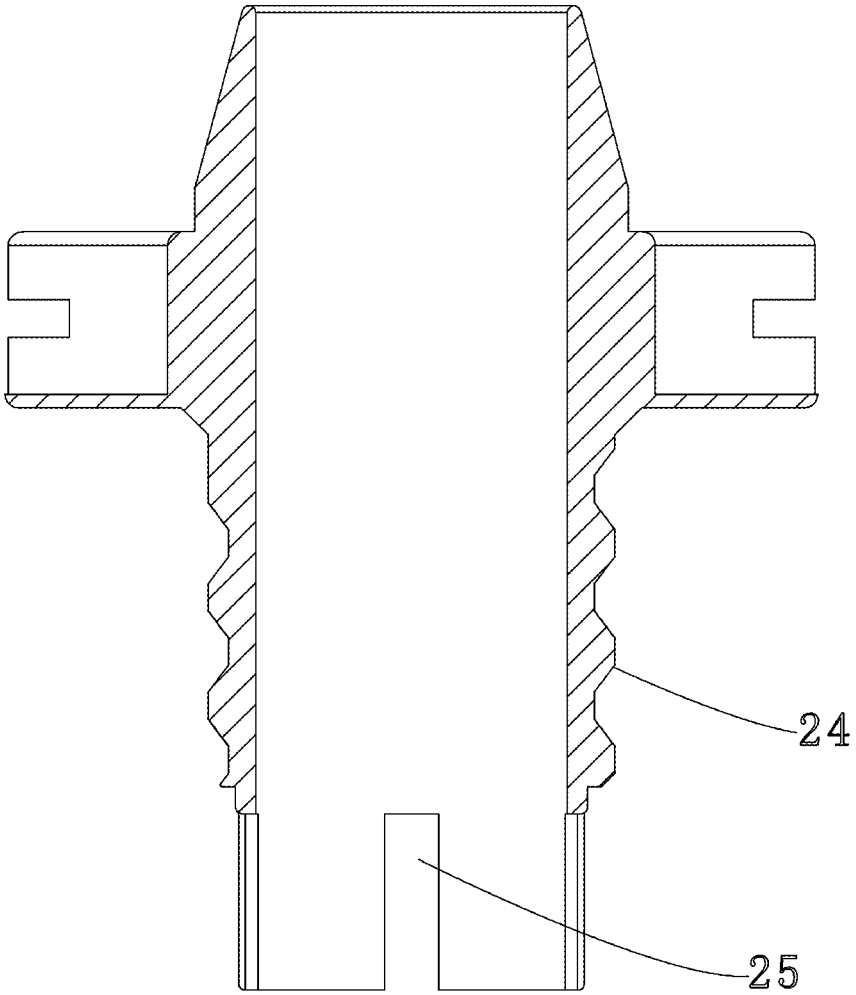
FIG. 11 is a sectional view of the lower disc.

Specifically, as shown in FIG. 7 and FIG. 8, the upper part of the upper disc 9 is an upper hollow pipe 12 with external threads, a middle part is an upper disc seat 13 extending outward, and a lower part is a first lower hollow pipe 14; as shown in FIG. 9, FIG. 10 and FIG. 11, an upper part of the lower disc 10 is a conical hollow lug boss 15 having a limiting notch 21 on the outer side, a middle part is a lower disc seat 16 extending outward, and a lower part is a second lower hollow pipe 17.

The upper hollow pipe 12 is in threaded connection with the umbrella cap 8 located above the umbrella surface 1.

The upper part of the inner pipe wall of the first lower hollow pipe 14 is provided with an umbrella rod internal thread 18; an inner hole at the lower part of the umbrella rod internal thread 18 is a conical hole 19 of the upper disc; the inner side wall of the conical hole 19 of the upper disc is provided with a limiting bump 20; the conical hollow lug boss is matched and extended into the conical hole 19 of the upper disc; and the outer wall of the limiting notch 21 is matched and fitted with the inner wall of the limiting bump 20. The matching between the limiting bump 20 and the limiting notch 21 is convenient for assembling the upper disc 9 and the lower disc 10 by preset angles, so that each group of hinged long ribs 6 and short ribs 7 are in the same vertical plane.

A first annular groove 22 is arranged at the periphery of the upper disc seat 13; the near ends of the long ribs 6 are fixed on an iron wire wrapped in the first annular groove 22; a second annular groove 23 is arranged at the periphery of the lower disc seat 16; and the near ends of the short ribs 7 are fixed on an iron wire wrapped in the second annular groove 23. The long ribs 6 and the short ribs 7 are hinged with the umbrella disc assembly 3 respectively by the iron wires wrapped in the corresponding annular grooves.

Further, long rib installing grooves 45 having the same number as the long ribs 6 are arranged at the outer circumference of the upper disc seat 13; the near ends of the long ribs 6 extend into the long rib installing grooves 45; short rib installing grooves 46 having the same number as the short ribs 7 are arranged at the outer circumference of the lower disc seat 16; and the near ends of the short ribs 7 extend into the short rib installing grooves 46. Further, the upper disc seat 13 is provided with an upper disc seat notch 47; the lower disc seat 16 is provided with a lower disc seat notch 48; the upper disc seat notch 47 and the lower disc seat notch 48 are both splayed and a groove is formed in the middle; and the ends of the upper disc seat notch and the lower disc seat notch are inserted into the groove after bound with the iron wires, which can protect the umbrella surface 1 and avoid scuffing hands.

Figure 12:
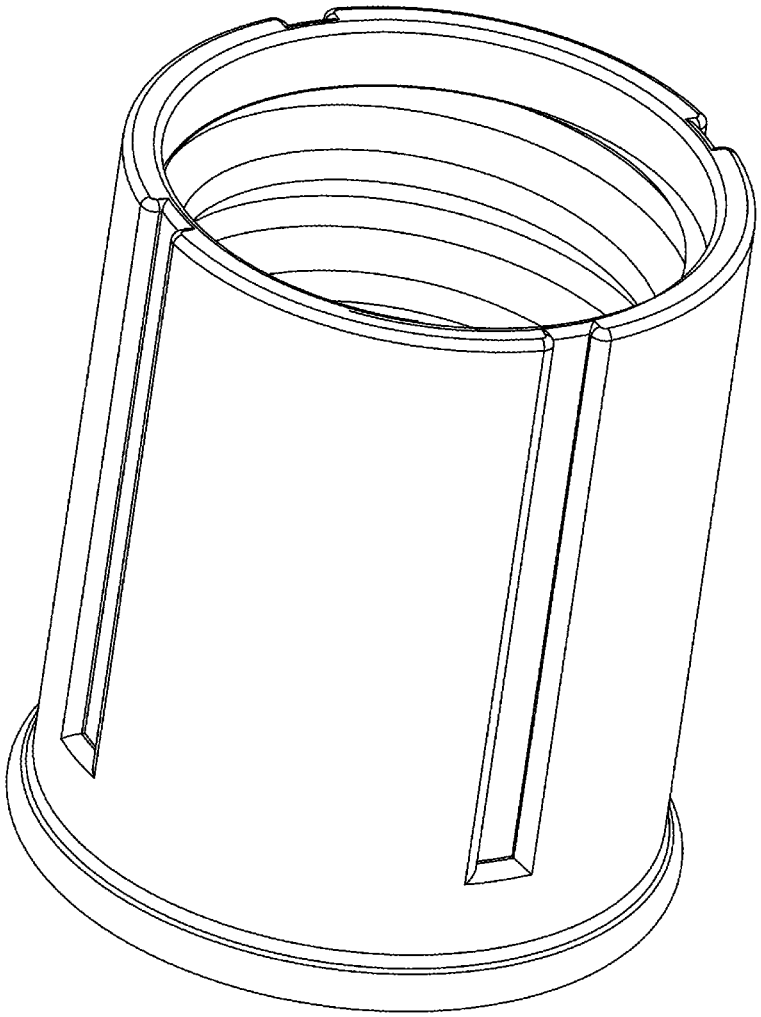
FIG. 12 is a three-dimensional diagram of an outer lock of the lower disc.
Figure 13:
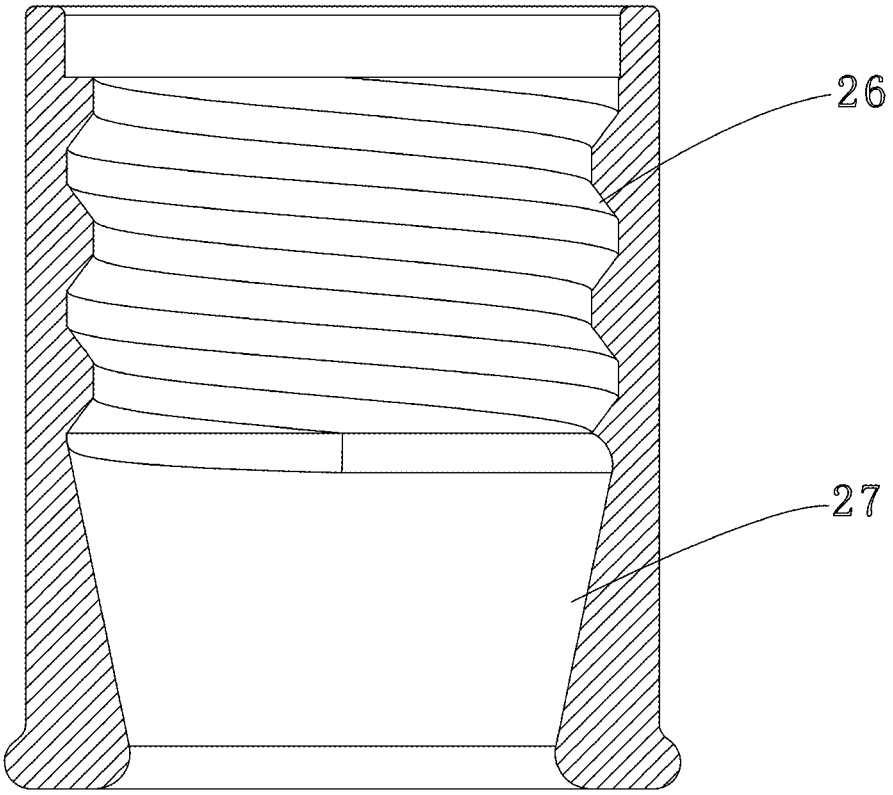
FIG. 13 is a sectional view of the outer lock of the lower disc.

The peripheral upper part of the second lower hollow pipe 17 is provided with a locking external thread 24, and a plurality of strip-shaped grooves 25 are arranged at the circumferential direction of the lower part of the second lower hollow pipe 17. As shown in FIG. 12 and FIG. 13, the outer lock 11 of the lower disc is a hollow pipe body, and the upper part of an inner hole wall is provided with a locking internal thread 26 matched with the locking external thread 24; a lower inner hole of the locking internal thread 26 is a conical hole 27 of the outer lock of the lower disc; the lower end of the conical hole 27 of the outer lock of the lower disc is a small opening end; and the diameter of the small opening end is less than the outer diameter of the lower part of the second lower hollow pipe 17, and is slightly greater than the rod diameter of the umbrella rod 4. The outer lock 11 of the lower disc is continuously screwed upward relative to the second lower hollow pipe 17 so that the conical hole 27 of the outer lock of the lower disc on the outer lock 11 of the lower disc can continuously extrude the lower part of the second lower hollow pipe 17 inwards, so as to lock the umbrella rod 4 located in the middle of the second lower hollow pipe 17.

Figure 14:
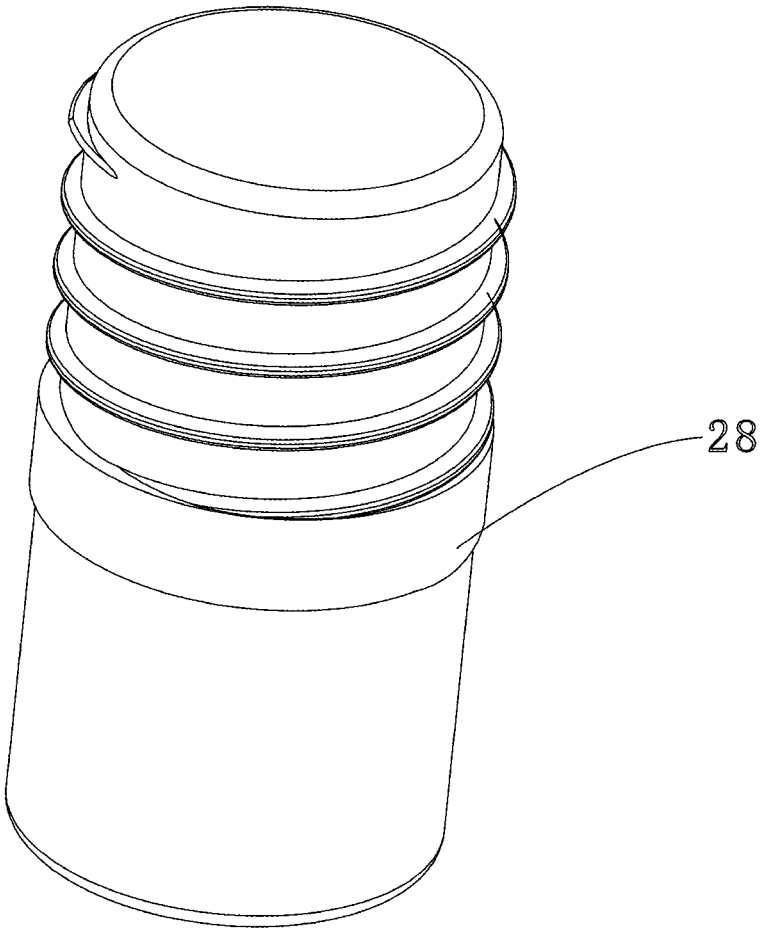
FIG. 14 is a three-dimensional diagram of a thread plug.
Figure 15:
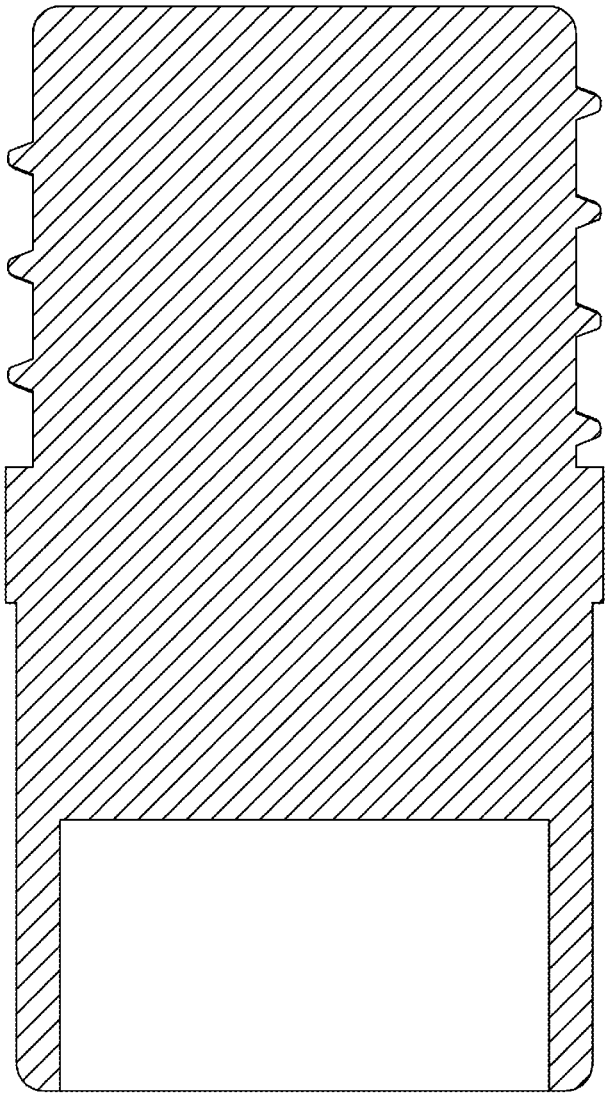
FIG. 15 is a sectional view of the thread plug.

The upper end of the umbrella rod 4 is connected with a thread plug 28 matched with the umbrella rod internal thread 18. As shown in FIG. 14 and FIG. 15, the thread plug 28 comprises a thread section and a smooth rod section. The outer wall of the smooth rod section is in interference fit with the inner pipe wall of the upper end of the umbrella rod 4. At the same time, the connection between the thread section and the smooth rod section extends outwards horizontally to form a convex ring that prevents the umbrella rod 4 from passing over the smooth rod section.

Figure 16:
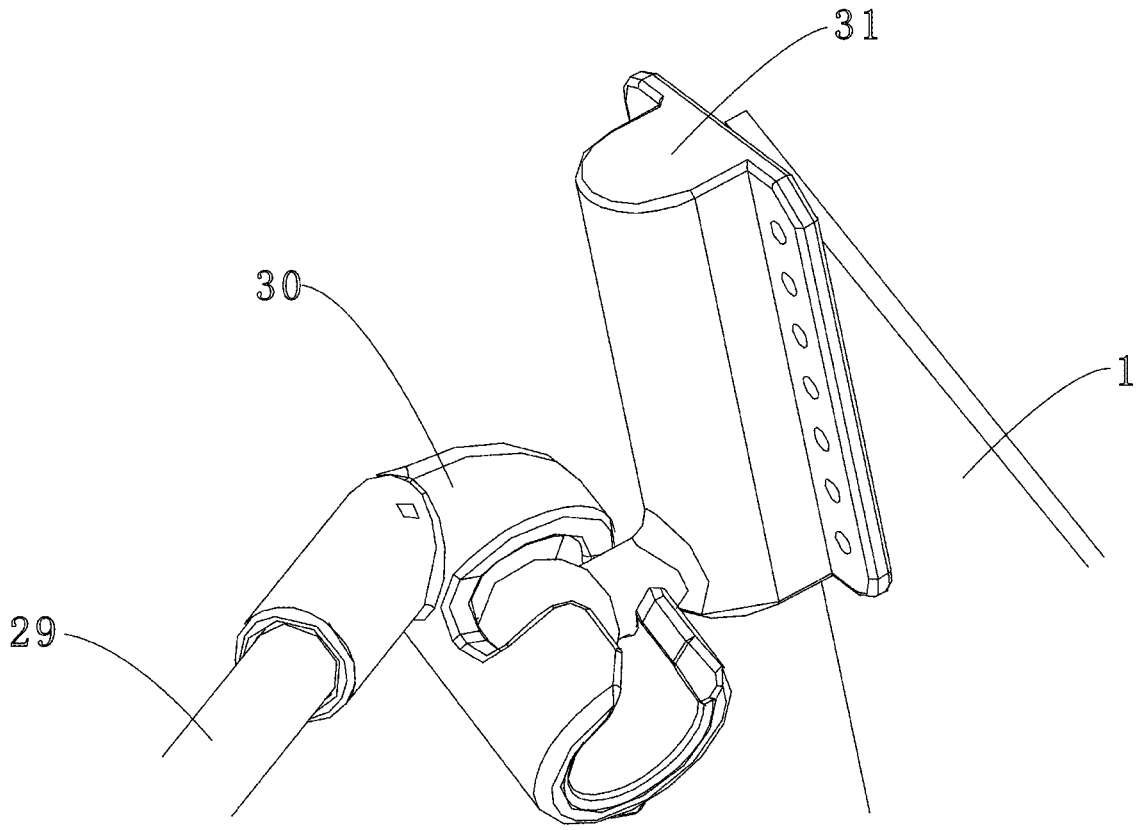
FIG. 16 is a schematic diagram of connection between ear pieces and an umbrella surface.
Figure 17:
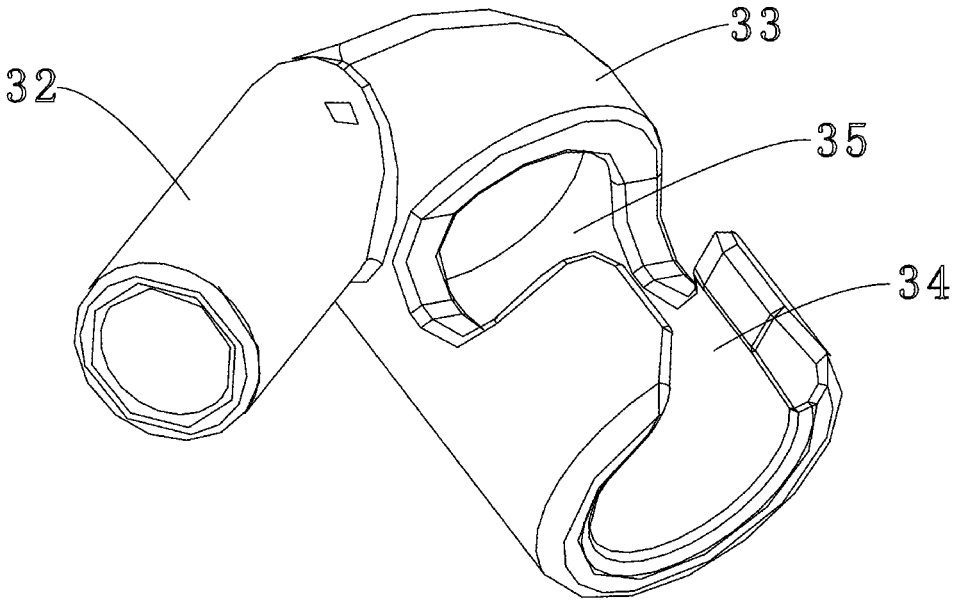
FIG. 17 is a three-dimensional diagram of a connecting piece I.
Figure 18:
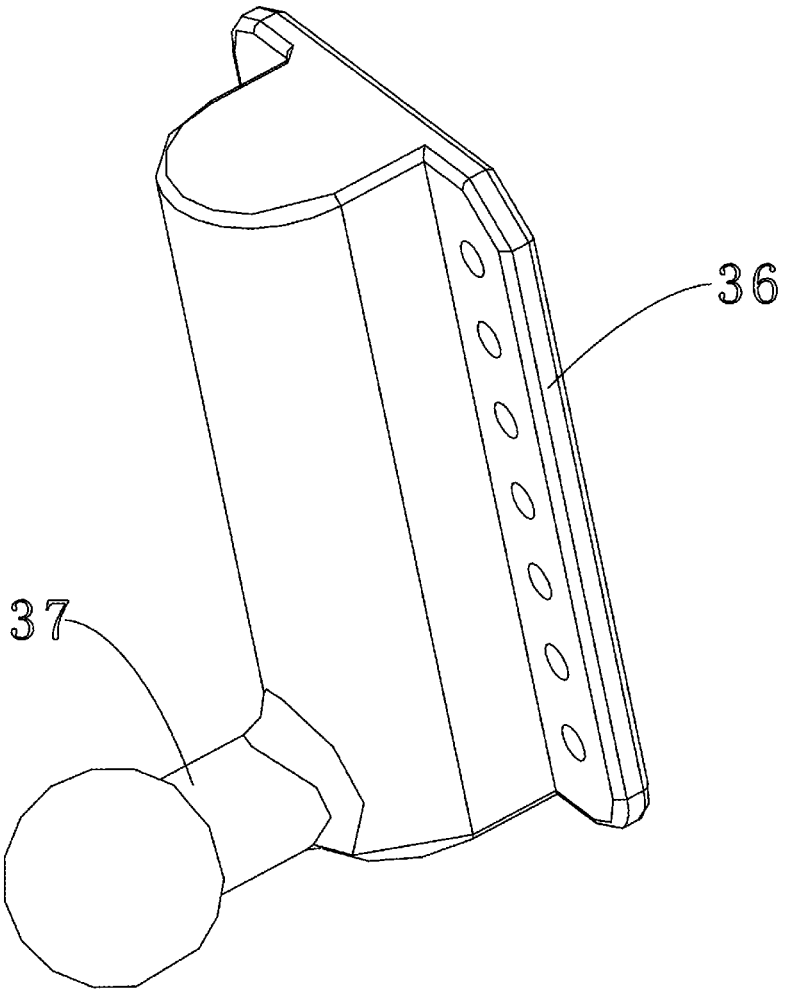
FIG. 18 is a three-dimensional diagram of a connecting piece II.

In a further specific embodiment, the ear pieces 5 are composed of two hinged supporting rods 29 and a triangular cloth surface connected between the two supporting rods 29. As shown in FIG. 16, the free ends of the supporting rods 29 are provided with connecting pieces 130; and both ends of the connecting sides of the ear pieces on the umbrella surface 1 are provided with connecting pieces 1131 matched with the connecting pieces 130. As shown in FIG. 17, each connecting piece 130 is composed of a supporting rod inserting pipe 32 and a sphere connecting seat 33 fixedly connected with the supporting rod inserting pipe 32; and the sphere connecting seat 33 is provided with a sphere channel 34 and a sphere rotating groove 35 which is located at the inner side of the sphere channel 34 and communicated with the sphere channel 34. As shown in FIG. 18, each connecting piece 1131 is composed of an umbrella surface connecting seat 36 and a sphere connecting piece 37 fixedly connected with the umbrella surface connecting seat 36; the umbrella surface connecting seat 36 is correspondingly inserted into the outer end of the umbrella rib on the umbrella surface 1 and is fixedly spliced with the umbrella surface 1; and the connecting rod on the sphere connecting piece 37 is matched through the sphere channel 34, and a sphere located at the top end of the connecting rod is matched into the sphere rotating groove 35.

The present invention realizes the detachable connection between the ear pieces 5 and the umbrella surface 1 through the matched connecting pieces 130 and connecting pieces 1131. Meanwhile, the unique structures of the connecting pieces 130 and the connecting pieces 1131 enable the ear pieces 5 to rotate relative to the umbrella surface 1 to realize the adjustable connection angle between the ear pieces 5 and the umbrella surface 1.

Figure 19:
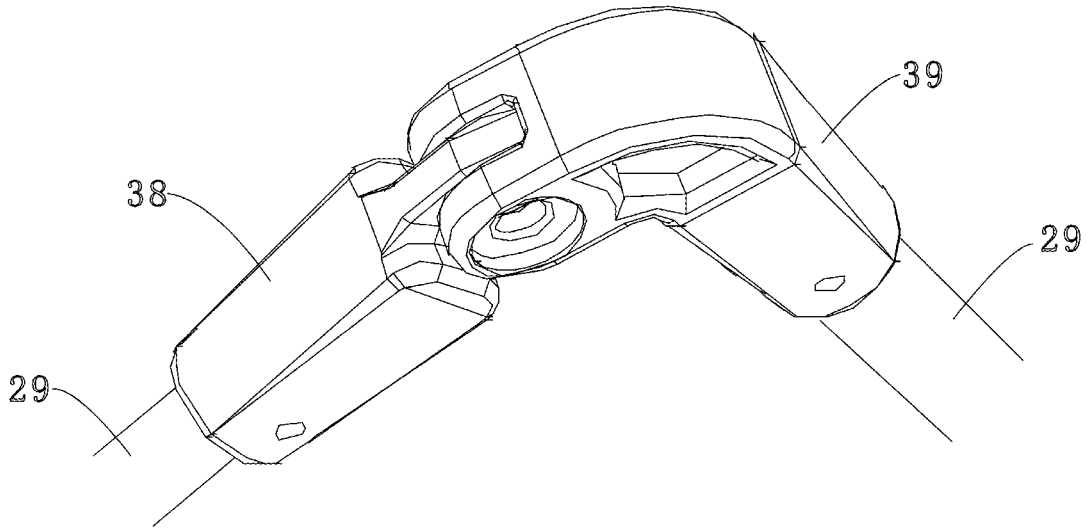
FIG. 19 is a schematic diagram of connection between two supporting rods.
Figure 20:
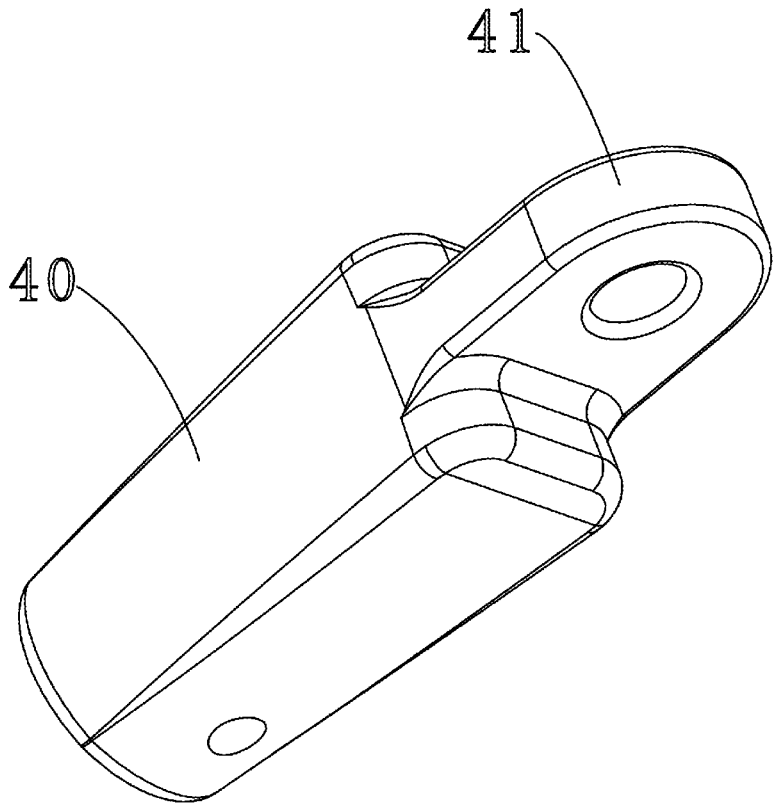
FIG. 20 is a three-dimensional diagram of a hinging piece I.
Figure 21:
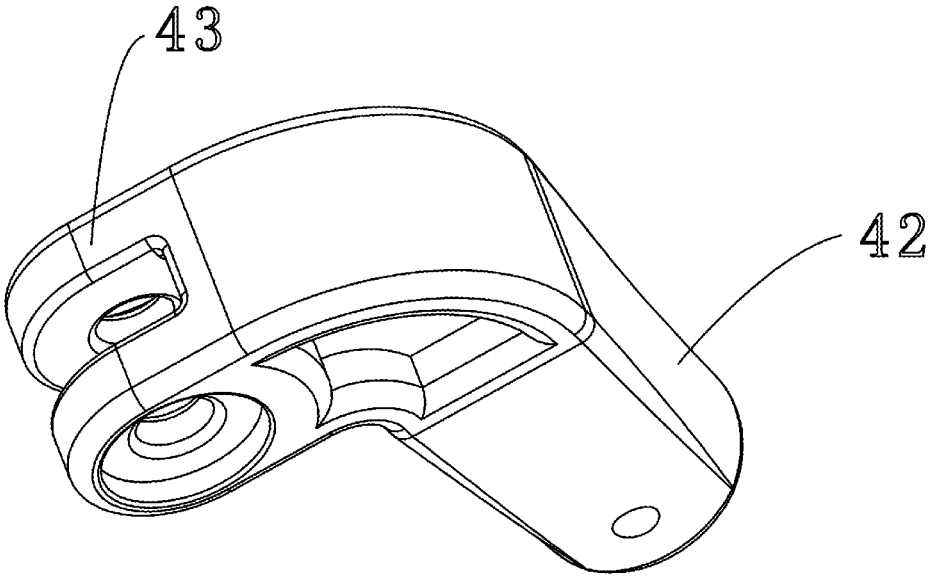
FIG. 21 is a three-dimensional diagram of a hinging piece II.

Further, as shown in FIG. 19, the hinged end of one of the supporting rods 29 is connected with a hinging piece 138, and the hinged end of the other supporting rod 29 is connected with a hinging piece 1139. As shown in FIG. 20, the hinging piece 138 is a linear hinging piece; one end of the hinging piece 138 is a supporting rod inserting head 140, and the other end is a hinging head 141. As shown in FIG. 21, the hinging piece 1139 is a curved hinging piece; one end of the hinging piece 1139 is a supporting rod inserting head 1142, and the other end is a hinging head 1143; and the hinging head 141 and the hinging head 1143 are jointly connected by a pivoting rod.

In the present invention, ground nail fixing straps I are installed on the bottom edges of the ear pieces 5 and on the edge of the umbrella surface between the two ear pieces so as to fix the umbrella tent in a tent state.

The present invention further comprises a ground mat 44 matched with the multifunctional umbrella tent. When the multifunctional umbrella tent is used in the tent state, the ground mat 44 is located below the umbrella surface 1 and the ear pieces 5; and when the multifunctional umbrella tent is expanded into the tent state, the edge of the ground mat 44 is fitted and aligned with the bottom edges of the two ear pieces 5 and the edge of the umbrella surface 1 located between the two ear pieces 5.

Moreover, the edge of the ground mat 44 is provided with ground nail fixing straps II, and the ground nail fixing straps II at the corresponding positions on the ground mat 44 correspond up and down to the ground nail fixing straps I on the upper ear pieces 5 and the edge of the umbrella surface 1, so that the ground mat 44, the ear pieces 5 and the umbrella surface 1 can be fixed to the ground jointly in the tent state.

In the present invention, the lower end of the umbrella rod 4 is a tip, which is convenient for inserting into the ground for fixation.

Further specifically, the umbrella rod 4 comprises an upper umbrella rod 49 and a lower umbrella rod 50, the upper end of the upper umbrella rod 49 is connected with the thread plug 28, and the lower end of the lower umbrella rod 50 is the tip; the lower end of the upper umbrella rod 49 is inserted into an upper opening of the lower umbrella rod 50, and the connection between the upper umbrella rod 49 and the lower umbrella rod 50 is provided with a lever locking piece 51; when the lever locking piece 51 is in an open state, the upper umbrella rod 49 can slide freely relative to the lower umbrella rod 50 to achieve length adjustment; and when the lever locking piece 51 is in a locking state, the upper umbrella rod 49 and the lower umbrella rod 50 are fixedly connected. The specific structure of the lever locking piece 51 can refer to the disclosure in the Chinese patent CN202883587U.

When the present invention is used as a tent, the end of the umbrella rod 4 is inserted into the ground to increase the wind resistance strength. To increase the comfort, the ground mat 44 matched with the present invention can also be placed on the ground. The shape of the ground mat 44 is consistent with the contour surrounded by the edge of the umbrella surface and the ground. Because the thread plug 28 at the top of the umbrella rod 4 is connected with the internal thread 18 of the umbrella rod on the upper disc 9, the outer lock 11 of the lower disc can be unscrewed and then the umbrella rod 50 can be unscrewed from the upper disc 9. After the umbrella rod 4 is taken off, the barrier in the middle of the tent is removed, and the user can feel the increase of the using space.

When the present invention is used as a beach umbrella, the umbrella rod 4 is vertically inserted into the ground; the ear pieces 5 can also be suspended below the umbrella surface 1 and connected with a windproof rope; and then the windproof rope is fixed on the ground through ground nails. The sun-proof area is increased, and the whole is firmer. The wind protection level is further enhanced. At the same time, the ear pieces 5 can also be removed. At this moment, the present invention is an ordinary beach umbrella.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A multifunctional umbrella tent, comprising an umbrella surface, umbrella ribs, an umbrella disc assembly, an umbrella rod and ear pieces, wherein the umbrella ribs support the umbrella surface, the umbrella disc assembly is hinged in the middle of the umbrella ribs, and the umbrella rod is connected to the lower end of the umbrella disc assembly; the ear pieces are triangular and detachably connected to both sides of the umbrella surface in an expanded state;

the umbrella ribs are evenly arranged on the lower end of the umbrella surface peripherally, and comprise a plurality of long ribs and a plurality of short ribs; the long ribs and the short ribs have the same quantity and are located in the same vertical plane; the long ribs are fixedly connected with the umbrella surface, and the short ribs are located at the lower ends of the long ribs; and one end of the short ribs away from the umbrella disc assembly are hinged with the corresponding long ribs;

the umbrella disc assembly comprises an umbrella cap, an upper disc, a lower disc and an outer lock of the lower disc; an upper part of the upper disc is an upper hollow pipe with external threads, a middle part is an upper disc seat extending outward, and a lower part is a first lower hollow pipe; an upper part of the lower disc is a conical hollow lug boss having a limiting notch on the outer side, a middle part is a lower disc seat extending outward, and a lower part is a second lower hollow pipe; the upper hollow pipe is in threaded connection with the umbrella cap located above the umbrella surface; the upper part of the inner pipe wall of the first lower hollow pipe is provided with an umbrella rod internal thread; an inner hole at the lower part of the umbrella rod internal thread is a conical hole of the upper disc; the inner side wall of the conical hole of the upper disc is provided with a limiting bump; the conical hollow lug boss is matched and extended into the conical hole of the upper disc; the outer wall of the limiting notch is matched and fitted with the inner wall of the limiting bump; a first annular groove is arranged at the periphery of the upper disc seat; the near ends of the long ribs are fixed on an iron wire wrapped in the first annular groove; a second annular groove is arranged at the periphery of the lower disc seat; the near ends of the short ribs are fixed on an iron wire wrapped in the second annular groove; the peripheral upper part of the second lower hollow pipe is provided with a locking external thread; a plurality of strip-shaped grooves are arranged at the circumferential direction of the lower part of the second lower hollow pipe; the outer lock of the lower disc is a hollow pipe body, and the upper part of an inner hole wall is provided with a locking internal thread matched with the locking external thread; a lower inner hole of the locking internal thread is a conical hole of the outer lock of the lower disc; the lower end of the conical hole of the outer lock of the lower disc is a small opening end; the diameter of the small opening end is less than the outer diameter of the lower part of the second lower hollow pipe, and is slightly greater than the rod diameter of the umbrella rod; and the upper end of the umbrella rod is connected with a thread plug matched with the umbrella rod internal thread.

2. The multifunctional umbrella tent according to claim 1, wherein the ear pieces are composed of two hinged supporting rods and a triangular cloth surface connected between the two supporting rods; the free ends of the supporting rods are provided with connecting pieces I; both ends of the connecting sides of the ear pieces on the umbrella surface are provided with connecting pieces II matched with the connecting pieces I; each connecting piece I is composed of a supporting rod inserting pipe and a sphere connecting seat fixedly connected with the supporting rod inserting pipe; the sphere connecting seat is provided with a sphere channel and a sphere rotating groove which is located at the inner side of the sphere channel and communicated with the sphere channel; each connecting piece II is composed of an umbrella surface connecting seat and a sphere connecting piece fixedly connected with the umbrella surface connecting seat; the umbrella surface connecting seat is correspondingly inserted into the outer end of the umbrella rib on the umbrella surface and is fixedly spliced with the umbrella surface; the connecting rod on the sphere connecting piece is matched through the sphere channel, and a sphere located at the top end of the connecting rod is matched into the sphere rotating groove.

3. The multifunctional umbrella tent according to claim 2, wherein the hinged end of one of the supporting rods is connected with a hinging piece I, and the hinged end of the other supporting rod is connected with a hinging piece II; the hinging piece I is a linear hinging piece; one end of the hinging piece I is a supporting rod inserting head I, and the other end is a hinging head I; the hinging piece II is a curved hinging piece; one end of the hinging piece II is a supporting rod inserting head II, and the other end is a hinging head II; and the hinging head I and the hinging head II are jointly connected by a pivoting rod.

4. The multifunctional umbrella tent according to claim 1, wherein ground nail fixing straps I are installed on the bottom edges of the ear pieces and on the edge of the umbrella surface between the two ear pieces.

5. The multifunctional umbrella tent according to claim 4, further comprising a ground mat matched with the multifunctional umbrella tent, wherein the ground mat is located below the umbrella surface and the ear pieces; and when the multifunctional umbrella tent is expanded into a tent state, the edge of the ground mat is fitted and aligned with the bottom edges of the two ear pieces and the edge of the umbrella surface located between the two ear pieces.

6. The multifunctional umbrella tent according to claim 5, wherein the edge of the ground mat is provided with ground nail fixing straps II, and the ground nail fixing straps II at the corresponding positions on the ground mat correspond up and down to the ground nail fixing straps I on the upper ear pieces and the edge of the umbrella surface.

7. The multifunctional umbrella tent according to claim 1, wherein long rib installing grooves having the same number as the long ribs are arranged at the outer circumference of the upper disc seat; the near ends of the long ribs extend into the long rib installing grooves; short rib installing grooves having the same number as the short ribs are arranged at the outer circumference of the lower disc seat; and the near ends of the short ribs extend into the short rib installing grooves.

8. The multifunctional umbrella tent according to claim 7, wherein the upper disc seat is provided with an upper disc seat notch; the lower disc seat is provided with a lower disc seat notch; the upper disc seat notch and the lower disc seat notch are both splayed and a groove is formed in the middle; and the ends of the upper disc seat notch and the lower disc seat notch are inserted into the groove after bound with the iron wires.

9. The multifunctional umbrella tent according to claim 1, wherein the lower end of the umbrella rod is a tip.

10. The multifunctional umbrella tent according to claim 9, wherein the umbrella rod comprises an upper umbrella rod and a lower umbrella rod, the upper end of the upper umbrella rod is connected with the thread plug, and the lower end of the lower umbrella rod is the tip; the lower end of the upper umbrella rod is inserted into an upper opening of the lower umbrella rod, and the connection between the upper umbrella rod and the lower umbrella rod is provided with a lever locking piece; when the lever locking piece is in an open state, the upper umbrella rod can slide freely relative to the lower umbrella rod; and when the lever locking piece is in a locking state, the upper umbrella rod and the lower umbrella rod are fixedly connected.

* * * * *